US007228967B1

(12) United States Patent
Sullivan

(10) Patent No.: US 7,228,967 B1
(45) Date of Patent: Jun. 12, 2007

(54) MEANS FOR SAFELY SUPPORTING FRAGILE ARTICLES

(75) Inventor: Michael J. Sullivan, West Chester, PA (US)

(73) Assignee: Homasote Company, Trenton, NJ (US)

( * ) Notice: Subject to any disclaimer, the term of this patent is extended or adjusted under 35 U.S.C. 154(b) by 652 days.

(21) Appl. No.: 10/687,338

(22) Filed: Oct. 16, 2003

Related U.S. Application Data

(60) Provisional application No. 60/509,431, filed on Oct. 7, 2003.

(51) Int. Cl.
*B65D 85/48* (2006.01)

(52) U.S. Cl. ..... 206/454; 206/591

(58) Field of Classification Search ..... 206/454, 206/449, 386, 594, 600, 521, 523, 586, 591, 206/592, 593
See application file for complete search history.

(56) References Cited

U.S. PATENT DOCUMENTS

| | | | |
|---|---|---|---|
| 2,086,688 | A | 7/1937 | Woodruff |
| 2,337,468 | A | 12/1943 | Hilger |
| 2,556,529 | A | 6/1951 | Farrell |
| 2,626,050 | A | 1/1953 | Frieberg |
| 2,665,804 | A | 1/1954 | Koester |
| 2,695,705 | A | 11/1954 | Powers et al. |
| 2,734,626 | A | 2/1956 | Koester et al. |
| 2,738,058 | A | 3/1956 | Hansen et al. |
| 2,741,362 | A | 4/1956 | Cortright |
| 2,873,024 | A | 2/1959 | Koester |
| 3,064,845 | A | 11/1962 | Maxwell |
| 3,216,564 | A | 11/1965 | Wolfe, Jr. et al. |
| 3,389,786 | A | 6/1968 | Lidgard |
| 3,414,124 | A | 12/1968 | Lidgard |
| 3,709,358 | A | 1/1973 | Andrews et al. |
| 3,938,660 | A | 2/1976 | Moehring |
| 3,939,978 | A | 2/1976 | Thomaswick |
| 4,014,435 | A | 3/1977 | Rowley et al. |
| 4,092,815 | A | 6/1978 | Rowley et al. |
| 4,225,043 | A | 9/1980 | Lastik |
| 4,287,990 | A | 9/1981 | Kurick |
| 4,892,193 | A | 1/1990 | Thomas |
| 5,085,030 | A | 2/1992 | Segawa et al. |
| 5,174,448 | A | 12/1992 | Flaig |
| 5,632,590 | A | 5/1997 | Pearson et al. |
| 5,678,691 | A | 10/1997 | Amado-Aguilar et al. |
| 6,035,790 | A | 3/2000 | Polando |
| 6,076,690 | A | 6/2000 | Hemmerly |
| 6,102,206 | A | 8/2000 | Pride |
| 6,158,589 | A | 12/2000 | Smith et al. |
| 6,305,566 | B1 | 10/2001 | Pigott et al. |

(Continued)

*Primary Examiner*—Shian T. Luong
(74) *Attorney, Agent, or Firm*—Sperry, Zoda & Kane

(57) ABSTRACT

The present invention provides a novel means for supporting multiple fragile articles which are often mounted upon a fixed substrate such as a pallet during shipment thereof. These longitudinal supporting members are generally rectangular in cross-section and can be of any length. Each support member includes an upper support surface and a longitudinally extending slot or recess which can form a mounting member, lip or recess therein to facilitate driving and retaining of securement members such as staples, therethrough, into the substrate located therebelow for securement to the substrate while defining a safety zone between the staples and the supported fragile articles for protection thereof. An upper panel of dissimilar material can be laminated over the upper supporting surface of the support member to control the coefficient of friction thereof.

18 Claims, 3 Drawing Sheets

U.S. PATENT DOCUMENTS 6,416,271 B1 7/2002 Pigott et al.
6,478,153 B1 11/2002 King
6,478,354 B1 11/2002 Eyal
6,527,120 B2 3/2003 Okamoto
6,536,607 B1 3/2003 Knoll et al.
6,539,881 B2 4/2003 Underbrink et al.
6,588,605 B1 7/2003 Volkert et al.
6,591,988 B2 7/2003 Trpkovski
6,666,334 B2 * 12/2003 Fujii ..... 206/586

* cited by examiner

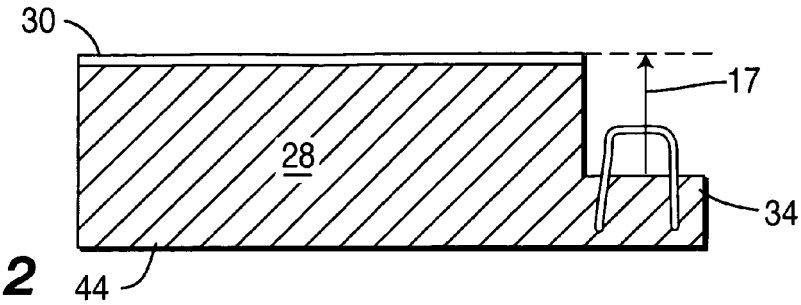
FIG. 2
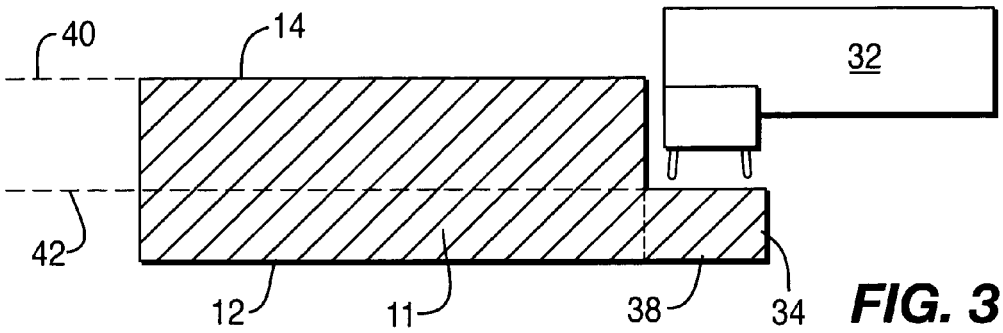
FIG. 3
FIG. 4
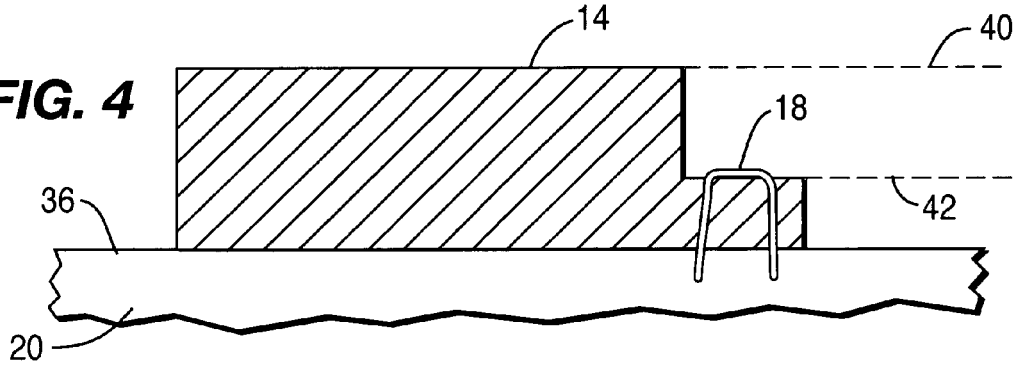
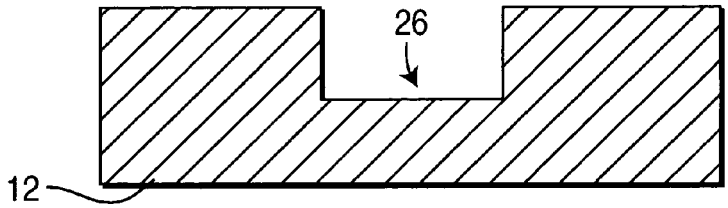
FIG. 5
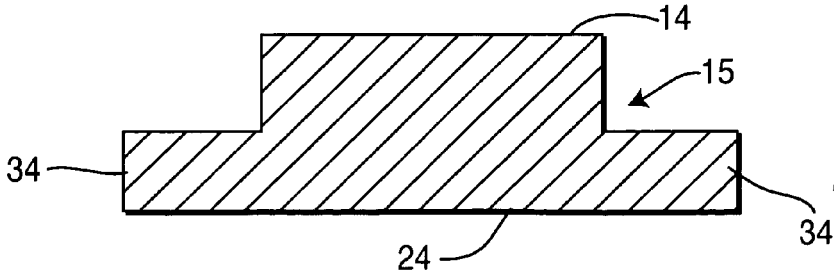
FIG. 6

MEANS FOR SAFELY SUPPORTING FRAGILE ARTICLES

This application hereby claims filing priority based upon U.S. provisional patent application No. 60/509,431 filed on Oct. 7, 2003 on a Support System For Shipping Fragile Articles, currently pending, which was filed by the same applicant as herein, namely, Michael J. Sullivan.

BACKGROUND OF THE INVENTION

1. Field of the Invention

Various supporting systems have utilized for supporting fragile articles such as glass panels, glass for windows, and other items in a safe manner to prevent damage or breakage thereof. Such fragile articles are often of such a configuration that they are stackable and, as such, are shipped in groups often placed vertically on their edges. The different types of apparatus specifically designed for supporting these fragile articles must be engineered to be particularly structurally strong when used for shipping thereof. Normally, these articles are shipped in stacked groupings while positioned on edge and positioned upon a generally horizontally extending substrate such as a pallet or the like and, as such, can easily be broken or damaged due during the normal rough handling commonly associated with handling thereof during shipping.

The present invention provides a unique improvement in the apparatus used heretofore for supporting such fragile panels or articles for safely during shipment thereof. Contact of the fragile articles with the metallic fasteners used in mounting of the supporting system can seriously damage or break the articles. Even the slightest contact of a glass article or sheet with an embedded metallic fastener such as a staple or screw can cause breakage or start a crack in one or more of the fragile articles. However, with the supporting system set forth herein, these metallic securement devices such as staples which hold the system to the substrate therebelow can maintained spatially distant from the fragile articles mounted upon the support members by defining a safety zone extending therebetween. This separation or safety zone is defined by the driving of the securing staples through a lower lip or ledge defined as the upper securement surface which is positioned substantially lower than the support plane of the upper supporting surface of the support member which receives the fragile articles positioned thereon.

2. Description of the Prior Art

Other patents which have been granted for the purpose of supporting and protecting of glass panels, or glass sheets or other breakable items during shipment include U.S. Pat. No. 2,086,688 patented Jul. 13, 1937 to G. C. Woodruff on a "Shipping Container" and assigned to The L.C. L. Corporation; and U.S. Pat. No. 2,337,468 patented Dec. 21, 1943 to W. P. Hilger on a "Shipping Container For Breakable Sheets" and assigned to B. H. Flanagan and M. H. O'Link; and U.S. Pat. No. 2,556,529 patented Jun. 12, 1951 to J. A. Farrell on a "Shipping Carton For Glass" and assigned to Cadillac Products, Inc.; and U.S. Pat. No. 2,626,050 patented Jan. 20, 1953 to J. M. Freiberg on a "Folding Shipping Frame For Glass" and assigned to Pittsburgh Plate Glass Company; and U.S. Pat. No. 2,665,804 patented Jan. 12, 1954 to M. C. Koester on a "Shipping Container For Glass Sheets" and assigned to Libbey-Owens-Ford Glass Company; and U.S. Pat. No. 2,695,705 patented Nov. 30, 1954 to H. O. Powers et al on a "Pallet Case" and assigned to Libbey-Owens-Ford Glass Company; and U.S. Pat. No. 2,734,626 patented Feb. 14, 1956 to M. C. Koester et al on a "Shipping Container For Glass Sheets" and assigned to Libbey-Owens-Ford Glass Company; and U.S. Pat. No. 2,738,058 patented Mar. 13, 1956 to R. C. Hansen et al on a "Pallet Case" and assigned to Libbey-Owens-Ford Glass Company; and U.S. Pat. No. 2,741,362 patented Apr. 10, 1956 to S. E. Cortright on a "Shipping Container For Glass" and assigned to General Motors Corporation; and U.S. Pat. No. 2,873,024 patented Feb. 10, 1959 to M. C. Koester on a "Shipping Container For Glass Sheets" and assigned to Libbey-Owens-Ford Glass Company; and U.S. Pat. No. 3,064,845 patented Nov. 20, 1962 to W. J. Maxwell on a "Shipping Container" and assigned to Pittsburgh Plate Glass Company; and U.S. Pat. No. 3,216,564 patented Nov. 9, 1965 to H. O. Wolfe, Jr. et al on a "Shipping Container" and assigned to Pittsburgh Plate Glass Company; and U.S. Pat. No. 3,389,786 patented Jun. 25, 1968 to E. J. Lidgard on a "Packaging For Frangible Sheets" and assigned to Flotepak Corporation; and U.S. Pat. No. 3,414,124 patented Dec. 3, 1968 to E. J. Lidgard on a "Container For Sheetlike Material" and assigned to Flotepak Corporation; and U.S. Pat. No. 3,709,358 patented Jan. 9, 1973 to B. Andrews et al on "Packages Of Glass In Sheet Form" and assigned to Pilkington Brothers Limited; and U.S. Pat. No. 3,938,660 patented Feb. 17, 1976 to R. J. Moehring on "Glass Sheet Shipping Packages" and assigned to Libbey-Owens-Ford Company; and U.S. Pat. No. 3,939,978 patented to R. J. Thomaswick on Feb. 24, 1976 on a "Flat Glass Shipping Container" and assigned to PPG Industries, Inc.; and U.S. Pat. No. 4,014,435 patented Mar. 29, 1977 to J. R. Rowley et al on a "Collapsible Rack For Shipping And/Or Storing Glass Sheets" and assigned to PPG Industries, Inc.; and U.S. Pat. No. 4,092,815 patented Jun. 6, 1978 to J. R. Rowley et al on a "Method Of Loading Glass Sheets On A Collapsible Rack For Storing Or Shipping" and assigned to PPG Industries, Inc.; and U.S. Pat. No. 4,225,043 patented Sep. 30, 1980 to J. P. Lastik on "Securing Pads For Sheet Shipping Containers"; and U.S. Pat. No. 4,287,990 patented Sep. 8, 1981 to J. F. Kurick on "Glass Sheet Shipping Packages" and assigned to Libbey-Owens-Ford Company; and U.S. Pat. No. 4,892,193 patented Jan. 9, 1990 to G. Thomas on an "Expanded Plastic Packaging System For Substantially Planar Objects"; and U.S. Pat. No. 5,085,030 patented Feb. 4, 1992 to T. Segawa et al on a "Method Of Transferring And Storing Glass Sheets And Tray Used In Method" and assigned to Nippon Sheet Glass, Co., Ltd.; and U.S. Pat. No. 5,174,448 patented Dec. 29, 1992 to V. I. Flaig on a "Container For Shipping And Stacking Sheets Of Glass" and assigned to Guardian Industries Corp.; and U.S. Pat. No. 5,632,590 patented May 27, 1997 to T. E. Pearson et al on a "Method And System For Loading Panels Into Shipping containers At A Work Station And End Effector For Use Therein" and assigned to Ford Motor Company; and U.S. Pat. No. 5,678,691 patented Oct. 21, 1997 to M. A. Amado-Aguilar et al on a "Corner Element And A Packing System For The Transportation Of Glass Sheet Packages" and assigned to Vidrio Plano, S. A. De C. V.; and U.S. Pat. No. 6,035,790 patented Mar. 14, 2000 to B. F. Polando on a "Shipping Skid"; and U.S. Pat. No. 6,076,690 patented Jun. 20, 2000 to T. S. Hemmerly on a "Fastener Free Container" and assigned to Concept Packaging Group; and U.S. Pat. No. 6,102,206 patented Aug. 15, 2000 to T. E. Pride on "Packaging For Panels, E.G. Glass Panels" and assigned to Cardinal IG Company; and U.S. Pat. No. 6,158,589 patented Dec. 12, 2000 to J. A. Smith et al on "Boxes With Internal Resilient Elements" and assigned to Motion Design, Inc.; and U.S. Pat. No. 6,305,566 patented Oct. 23, 2001 to M. J. Pigott et al on a "Container For Fragile Articles" and assigned to Nucon Corporation; and U.S. Pat. No. 6,416,271 patented Jul. 9, 2002 to M. J. Pigott et al on a "Drop Box Container" and assigned to Nucon Corporation; and U.S. Pat. No. 6,478,153 patented Nov. 12, 2002 to R. C. King on a "Package For Framed And Unframed Single Mirrors"; and U.S. Pat. No. 6,478,354 patented Nov. 12, 2002 to M. Eyal on a "System And Method For Packing And Transporting Sheet Materials"; and U.S. Pat. No. 6,527,120 patented Mar. 4, 2003 to F. Okamoto on "Containers For Packaging Glass Substrates" and assigned to Corning Incorporated; and U.S. Pat. No. 6,536,607 patented Mar. 25, 2003 to P. Knoll et al on a "Transportable Rack" and assigned to Schneider National Inc.; and U.S. Pat. No. 6,539,881 patented Apr. 1, 2003 to S. L. Underbrink et al on a "Pallet Having A Pallet Deck With A Movable Portion And An Associated Method" and assigned to The Boeing Company; and U.S. Pat. No. 6,588,605 patented Jul. 8, 2003 to V. W. Volkert et al on a "Planar Article Rack Having Closeable Holding Members" and assigned to Cardinal CG Company; and U.S. Pat. No. 6,591,988 patented Jul. 15, 2003 to P. Trpkovski on "Material Handling For The Insulating Glass Industry" and assigned to Cardinal Glass Industries, Inc.

SUMMARY OF THE INVENTION

The present invention provides a supporting means for safely supporting fragile articles with respect to a substrate therebelow. The supporting means is secured to the substrate by securement devices such as staples driven therethrough. Preferably this support means provide a plurality of individual support members organized into an array and mounting upon the substrate therebelow. Each of the plurality of support members are oriented extending longitudinally with respect to one another and are preferably made of a flexibly resilient fiberboard material of medium density. These individual support members are adapted to be positioned upon a substrate therebelow for mounting of the fragile articles thereabove. Each support member can include a main body of flexibly resilient fiberboard material with an upper supporting surface positioned on the main body and defining a support plane extending generally horizontally thereacross for supporting fragile articles thereupon. The upper supporting surface is adapted to support fragile articles thereabove in spaced relation to the substrate therebelow to facilitate protection from breaking or damaging. The support member also includes a lower supporting surface positioned spatially distant from and below the upper supporting surface and extending generally parallel with respect thereto. This lower supporting surface is preferably adapted to abut a substrate located therebelow to facilitate mounting thereupon.

The support member further, preferably, but optionally, includes an upper panel of plastic or other material extending over the upper portion of the main body for defining the upper supporting surface to facilitate moving and supporting of fragile articles therealong while in abutment therewith. This upper panel will be of a dissimilar material from the flexibly resilient medium density fiberboard of the main body and can be formed of a paper or wax coated paper sheeting or can be made of more slippery materials such as Mylar or the like.

The supporting means of the present invention further includes a mounting member preferably integrally configured with respect to the support member and extending longitudinally therealong. This mounting member is preferably securable with respect to the substrate in abutment therebeneath for facilitating attachment of the support member also relative thereto. Each mounting member preferably includes a lower securement surface positionable in abutment with respect to the substrate therebelow responsive to positioning of the lower supporting surface of the support member into abutment with respect to the substrate. Preferably the mounting member also includes an upper securement surface extending generally horizontally and located at a position laterally adjacent and below the upper supporting surface of the support member and positioned spaced from and above the lower securement surface. The upper securement surface preferably defines a securement plane extending generally horizontally which is positioned spaced below the support plane and extending generally parallel with respect thereto. The upper securement surface preferably extends generally parallel to and above the lower securement surface. Also the lower supporting surface and the lower securement surface are preferably coplanar and integrally formed with respect to one another.

The upper securement surface is adapted to receive a securement device such as a staple or the like driven therethrough into engagement with the substrate therebelow to preferably facilitate direct securement of the mounting member to the substrate. This direct securement will attach the support member to the substrate immediately therebelow with the lower supporting surface thereof in direct contact with the substrate positioned therebelow. The upper securement surface preferably defines a safety zone thereabove in the area below the support plane of the upper supporting surface to create spacing therebetween in order to prevent contact between any securement devices extending therethrough and any fragile articles positioned upon the upper support surface. This safety zone means preferably is defined in the area below the support plane and above the securement plane for added safety in preventing abutment between the fragile articles and the mounting staples.

It is an object of the present invention to provide a means for supporting fragile articles wherein said support of fragile articles such as glass panels is performed in a flexibly resilient manner with enhanced safety.

It is an object of the present invention to provide a means for supporting fragile articles wherein the supporting surface thereof can be covered with an upper layer of dissimilar material such as Mylar or the like to prevent sealant from bonding to the medium density fiberboard of the main support means and to facilitate sliding movement of the articles while in contact with the upper supporting surface.

It is an object of the present invention to provide a means for supporting fragile articles of the present invention wherein packing of fragile or glass panels can occur whether under wet or dry conditions and in various orientations.

It is an object of the present invention to provide a means for supporting fragile articles wherein usage with any type of a substrate or skid configuration is made possible.

It is an object of the present invention to provide a means for supporting fragile articles wherein contact between the securing devices such as staples and the supported fragile articles is prevented.

It is an object of the present invention to provide a means for supporting fragile articles mounted upon a substrate therebelow wherein a safety zone is defined for maintaining of safe spacing between the supported fragile articles and the metallic securement staples.

It is an object of the present invention to provide a means for supporting fragile articles wherein structural support is provided by medium density fiberboard which is flexibly resilient in order to provide a cushioned mounting surface for the fragile articles positioned thereupon.

It is an object of the present invention to provide a means for supporting fragile articles wherein a mounting lip can be provided extending longitudinally along at least one lateral edge of the support means to facilitate direct mounting thereof to the substrate therebelow while simultaneously maintaining the mounting or securement devices separated from the supported fragile articles.

It is an object of the present invention to provide a means for supporting fragile articles being mounted upon a substrate therebelow by securement devices driven therethrough wherein an upper supporting surface is positioned above and distant from an upper securement surface which facilitates attachment of the support means to the substrate therebelow while at the same time minimizing the chance of contact of the supported fragile articles with any portion of the support means other than the medium density fiberboard or friction control coating extending thereover.

It is an object of the present invention to provide a means for supporting fragile articles being mounted upon a substrate therebelow by securement devices driven therethrough which is of minimal cost.

It is an object of the present invention to provide a means for supporting fragile articles being mounted upon a substrate therebelow by securement devices driven therethrough which can easily be formed by machining one edge of a single longitudinally extending strip of medium density fiberboard.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 2 is a side cross-sectional view of an embodiment of the means for supporting fragile articles of the present invention showing the safety zone above the upper securement surface of the mounting member and illustrating the positioning of an upper panel extending across the upper supporting surface in order to provide a friction control layer thereupon and showing a securing staple partially dislodged from the mounting member;

FIG. 3 is a side cross-sectional view of an embodiment of the means for supporting fragile articles of the present invention shown with a securement driving means such as a stapling device in position to drive a staple through the mounting member into the substrate therebelow for mounting thereof;

FIG. 4 is a side cross-sectional view of an embodiment of the present invention showing a staple operatively securing the mounting member to the pallet substrate therebelow in order to firmly attach the support member relative to the substrate therebelow;

FIG. 5 is a side cross-sectional view of an alternative embodiment of the means for supporting fragile articles of the present invention showing a slot defined centrally therein which defines the upper securement surface centrally;

FIG. 6 is another alternative embodiment of the means for supporting fragile articles of the present invention showing a longitudinal slot or lip extending along both lateral edges thereof to define a double shoulder cross-section.

DETAILED DESCRIPTION OF THE PREFERRED EMBODIMENT

The present invention provides a system for safely supporting fragile articles above a substrate pallet which is particularly usable positioned within shipping containers. The supporting system disclosed herein can be used in or with any of many different types of shipping container devices. It is particularly usable for supporting fragile articles or breakable articles such as glass panels or sheets 22 to facilitate shipment or other movement thereof. The present invention provides the means for safely supporting the glass panels 22, and can be utilized secured to substrates 20 such as pallets of many different shapes or configurations. The support system herein can be used with open pallets or enclosed boxing or any types of housing which contain fragile articles confined therewithin to facilitate handling, shipping or storage thereof.

In particular, the present invention includes a means for supporting which is preferably longitudinally extending and is preferably approximately three inches in width and approximately one-half to seven-sixteenths inches in vertical height. All of these dimensions are subject to reasonable variation while still practicing the basic concept of the invention set forth herein. Specifically, the vertical height and width can vary based upon the particular manner of usage. The longitudinal lengths can vary significantly between six and twelve feet, or any other length which may be desired in order to support specifically configured fragile articles 22 such as glass panels or for use with substrates of various sizes.

Figure 1:
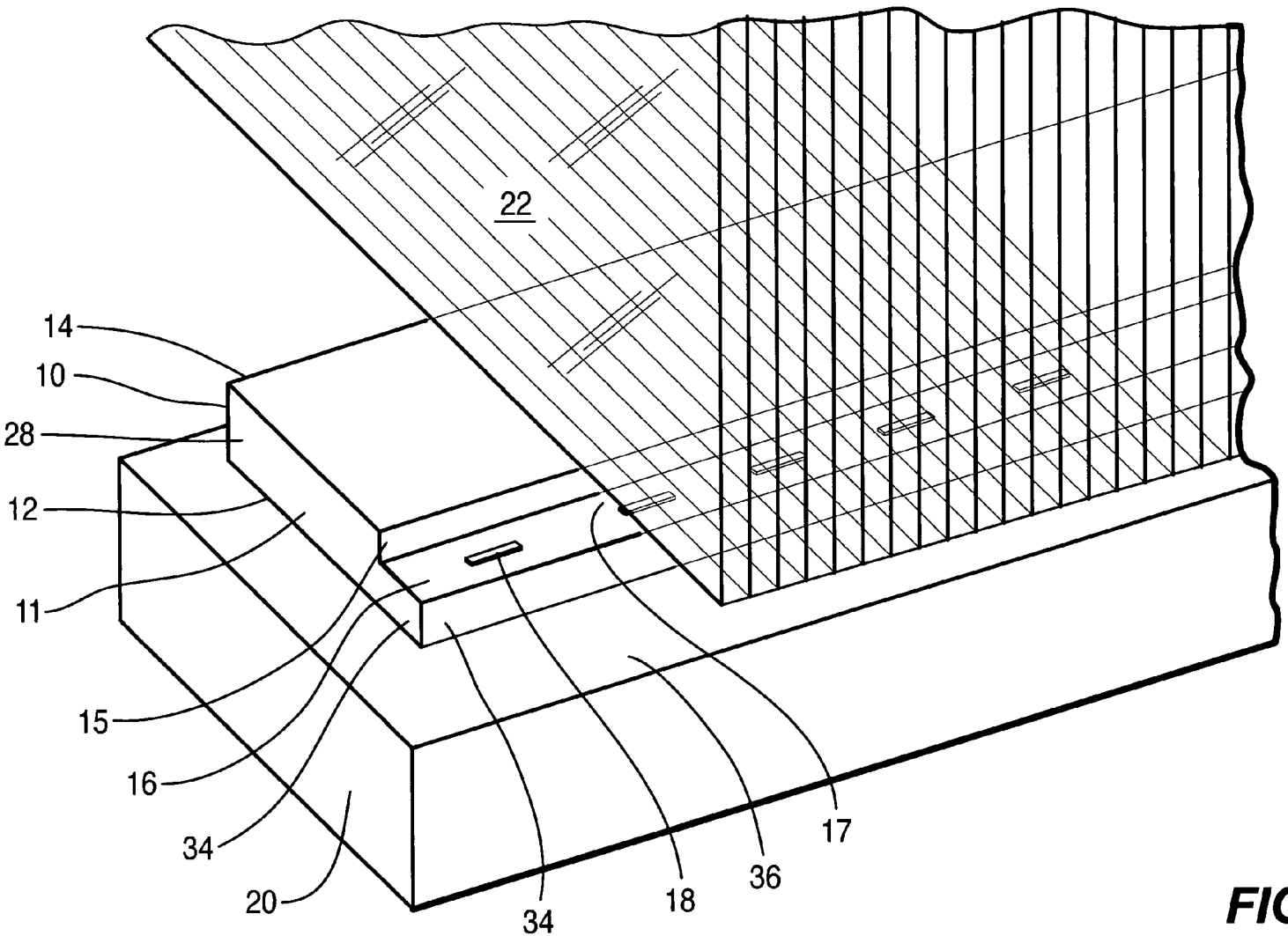
FIG. 1 is a perspective illustration of an embodiment of the means for supporting fragile articles of the present invention shown mounted upon a substrate pallet with fragile articles positioned thereupon.

In most applications, a plurality of such support means 10 will be positioned upon a substrate generally extending parallel with respect to one another to form a supporting array thereof extending over the upper substrate surface 36. The positioning of one such support means 11 beneath the glass panels 22 is shown best in the perspective illustration in FIG. 1.

Each longitudinally extending support means 10 will preferably include a support member 11 having an upper supporting surface 14 upon which the fragile articles 22 will abut when supported thereby. Each support means will also include a lower supporting surface 12 adapted to be positioned upon the upper surface 36 of substrate 20. Each longitudinally extending support means 10 also will include a mounting member 34 which can be shaped like a lip extending outwardly therefrom laterally. Preferably, the mounting member 34 and the support member 11 will be formed from a single integral piece of medium density fiberboard. Thus when the mounting member 34 is stapled to the substrate 20, then the support member will also be attached thereto. The mounting member 34 will preferably define a lower securement surface 38 therebeneath which is designed to be brought into direct abutment with the upper surface 36 of a substrate 20 for support thereabove and for securement directly thereto. In this manner the support means 10 of the present invention will space the fragile glass panels 22 at a safe distance from the substrate 20 sufficient to yield a comfortable level of protection to prevent breakage or damaging of the fragile articles 22 which can be caused by contacting with the substrate or vibrations thereof when in abutment with the relative hard substrate, which is normally made of a solid material such as wood.

In the preferred configuration of the present invention, each of the longitudinally extending support means 10 of the present invention is made of a medium density fiberboard which is somewhat flexibly resilient and provides some cushioning to the mounting for the glass panels or other fragile articles 22 positioned thereon, while at the same time being strong enough or hard enough to be capable of being machined such as when defining a longitudinal slot 15 therealong. Preferably, support means 10 are capable of being machined to form a recess extending therealong to define a lip 34, preferably along one edge thereof as shown in FIGS. 2,3 and 4.

The lip or mounting member 34 so formed will define an upper securement surface 16 on the upper surface thereof. This upper securement surface 16 preferably extends generally parallel with respect to the upper supporting surface 14 of the support member 10 and is spaced upwardly therefrom. The forming of the mounting member or lip 34 is achieved preferably by machining the support means 10 in such a manner as to form a recessed ledge or shoulder thereadjacent to facilitate securement to the substrate 20 therebelow in such a manner that the securement screw or staple 18 driven therethrough will not come into contact supported fragile article 22. This recessed surface provides the upper securement surface 16 defined on the mounting member 34 which preferably is defined by the longitudinal slot 15.

The vertical spacing between the upper securement surface 16 and the upper supporting surface 14 will define the safety zone means 17 therebetween. This safety zone 17 provides added safety in protecting the supported fragile articles 22 by preventing contact with securement staples 18 driven through the upper securement surface. Also, often such a staple 18 can work loose or be vibrated loose which would move it slightly upwardly while still being at least partially embedded in the mounting member 34. One of the important aspects of the present invention is to prevent any contact between glass panels 22 and any of the securement staples or screws 18, particularly those extending even partially upwardly from the upper securement surface 38. These securement devices 18 are very hard since they are normally made of metallic material and when embedded in the support means 10 for securing thereof with respect to the substrate 20, they can badly damage the fragile articles 22 if brought into contact therewith.

In a preferred configuration of this invention, staples will usually be used as the securement means 18, and will be driven by a stapling device 32 into the lip 34 through the upper securement surface 16. Each of the staples 18 will travel downwardly as it is being inserted through the upper securement surface 16 to such an extent that it will engage the substrate 20 positioned therebelow. Numerous staples 18 will be driven through each mounting member 34 into the substrate 20 therebelow to firmly secure the mounting member 34 thereto and, also, to securely attached the associated support member 11 with respect thereto.

Preferably, substrate 20 will be a pallet which can be formed of multiple 2×4's or other sizes of wood components which can be assembled to provide an overall supporting platform or substrate structure. The support members 11 of the present invention are designed to separate the substrate or pallet 20 from any of the glass panels 22 or other fragile articles positioned upon the upper supporting surface 14 thereof for enhancing safety thereof, especially during shipping.

In most applications, the substrate 20 will comprise a pallet with a plurality of horizontally extending parallel members which define the upper substrate surface 36. In accordance with this embodiment of the present invention, preferably, one support means 10 will be secured upon each such parallel member of substrate 20 such that it extends laterally and longitudinally thereupon. In some applications, the substrate 20 can define a solid or continuous floor member in which case each of the support means 10 should also be positioned generally extending parallel with respect to one another longitudinally and spaced apart laterally from one another to form a horizontally extending array thereof.

With this configuration of the present invention, a unique and simple means of installation is provided by allowing a stapling device or gun 32, as shown in FIG. 3, to be brought into abutment with respect to the upper securement surface 16 such that a staple 18 can be driven downwardly therefrom through the mounting member or lip 34, and further through the upper substrate surface 36 into the substrate 20 therebelow in order to directly secure the lower securement surface 38 of mounting member 34 thereto and to, thusly, attach the associated support member 11 with respect thereto. Since the staples 18, which are usually made of metal, are driven only through the upper securement surface 16, they will not come into contact with the fragile articles 22 which are supported at an elevated portion with respect thereto upon said upper supporting surface 14 of the support members 11. Thus, each support member 11 will define an upper supporting surface 14 which is spaced upwardly by a distance equal to the vertical dimension of the safety zone 17 away from the staples 18, each of which will extend downwardly through upper securement surface 16 of mounting lip 34. As such, contact between a glass panel 22 positioned upon the upper supporting surface 14 of the support member 11 and one of the staples 18 embedded in mounting member 34 will be prevented. This spacing is an important aspect of the present invention because such metal staples 18 can easily cause cracking or otherwise fracture any glass panels or plates or other fragile articles 22 with which it is brought into contact.

Furthermore, under some conditions a staple 18 may tend to loosen such that it will raise or pull outwardly slightly due to moisture, temperature differences, vibrations or other causes. Such a protruding embedded staple can severely damage such fragile articles if brought into contact therewith. The vertical dimension of the safety zone 17, as shown in FIG. 2, will be chosen to be of such a significant depth in order that, even such an elevated embedded staple as shown in the FIG. 2 embodiment, it will not be capable of contacting the fragile articles 22, thus enhancing the protection thereof especially during shipping. In most situations, if the staple moves vertically to such an extent that it will extend to a height near vertical height of the support plane 40 of upper supporting surface 14, then the staple would become at least partially disengaged from the mounting lip 34 such that it no longer be capable of damaging a fragile article 22 if brought into contact therewith. Thus, the present invention provides a novel overall mounting configuration formed by an array or plurality of support members 11 extending generally parallel to one another, which will minimize contact of glass panels or other fragile articles 22 from contact with any metallic fasteners mounted thereon. Thus, the fragile articles 22 will only contact the upper supporting surfaces 14 of the support member 11 and the flexible resilience of the medium density fiberboard of the main body 44 thereof will provide enhanced protection especially from vibrations commonly experienced during shipping.

Another alternative configuration for the present invention is shown in FIG. 6 wherein a double shoulder cross-section 24 is shown. With this construction, a mounting lip 34 is positioned on each opposite lateral edge of the supporting member 11. Another further alternative configuration is shown in FIG. 5 wherein a central slot 26 is defined through which staples 18 can be driven. With the FIG. 5 construction, portions of the upper supporting surface 14 will be positioned laterally on each side of central slot 26.

It should be appreciated that one of the important aspects of the present invention is in the preferred positioning of the mounting members 34 at the lateral outer edges of the support members 10. This is important because it allows a stapler device 32 to be positioned directly upon the upper securement surface 16 to facilitate driving of staples 18 therethrough more easily. This capability is important because normally such stapling devices 32 are large and bulky and positioning thereof within, for example, a central slot 26 may be somewhat difficult while positioning thereof on the laterally located mounting lips 34 is much easier due to the added lateral space available for providing ease of access to the securement surface 16 when positioned at the outer lateral edge of support means 10. As such, certain larger staple driving mechanisms 32 would be too big to be positioned within a central slot 26 for driving a staple 18 downwardly therewithin. However, the possibility of a placing the mounting member 34 centrally within the support member 11 is certainly within contemplation under the present invention, because with very slim or otherwise small stapling devices, the central slot configuration shown in FIG. 5 could be utilized.

It should further be appreciated that the support means 10 of the present invention is preferably made from a fiberboard of medium density. Such fiberboard provides a flexible resilience or cushioning to the overall construction of support means 10 which enhances protection of the fragile glass panels 22, especially from forces of vibration often encountered during shipping or other movement. Use of lower density fiberboard would certainly provide more flexible resilience, however such softer fiberboard would be much more difficult to machine or mill in such a manner as to define a mounting lip 34 or slot 26 thereon and thus would be undesirable with the support system of present invention. Machining of medium density fiberboard is much easier and much more uniform than machining of low density fiberboard which also has a tendency to loose structural integrity during most types of machining because it is too soft to hold shape. Forming of the recessed slots 15 in the support means 10 can be achieved in many ways, however, the use of a rotating router bit, or the use of a rotating dado blade have both been found to be effective ways of defining these slots 15 whether they are edge mounted slots to form the laterally positioned mounting lips 34, or centrally mounted slots 26.

One of the important operational parameters of the support member 11 of the present invention is the control of the coefficient of friction of the upper surface thereof. As such, the present invention includes the concept of the securement of an upper mounting surface friction control layer or upper panel 30 which preferably will extend across the entire upper supporting surface 14 in such a manner that any glass panel 22 positioned thereupon will contact the friction control layer rather than the main body 44 of the support member 11. This upper control layer 30 can preferably be laminated, or otherwise attached to the upper supporting surface 14. Upper panel 30 can be formed of a plastic laminate material, a paper material, a wax-coated paper material, or even a Mylar or other low coefficient of friction material. This upper panel 30 can be attached to the fiberboard by adhesive, glue or by any other conventional means. In this manner, the coefficient of friction between the support members 11 and the fragile articles 22 positioned thereupon can be carefully controlled such that the system of the present invention is usable in many different types of applications.

The choice of material for the upper supporting surface 14 of support member 11 can also important to prevent sealant from bonding to the fiberboard which is a common problem when shipping glass or other similar fragile panels. Also, the process for moving of the fragile articles 22 onto the upper supporting surfaces 14 of the support members 11 must be considered when determining the proper choice for the coefficient of friction of the upper supporting surfaces 14. The use of a very slick surface for the upper panel 30 on support member 11 provides the capability of more easily sliding heavier loads of fragile panels 22 into position within a shipping crate. The use of upper panels 30 of relatively slick materials such as plastic or Mylar allows fragile articles 22 to travel thereover while in abutment therewith with a minimal amount of scuffing, and with the elimination of pressure points which are often caused by such scuffing. In other situations where the fragile articles 22 are to be placed directly downwardly onto the support members 11, the use of a more slick upper surface material on the upper supporting surfaces 14 may not be needed since sliding of fragile articles 22 while in contact with the upper supporting surface 14 thereof would not an important consideration.

In the preferred configuration, a plurality of support means 10 will be positioned upon the substrate 20 in an orientation extending generally parallel with respect to one another. The support members 11 thereof will thusly define a supporting array of the upper supporting surfaces 14 positioned adjacent to recessed slots 15 which will greatly facilitate installation by allowing the driving of staples through the recessed mounting lips 34 thereof while at the same time providing easily accessible and safe means for supporting for the glass panels 22 positioned thereupon.

Figure 7:
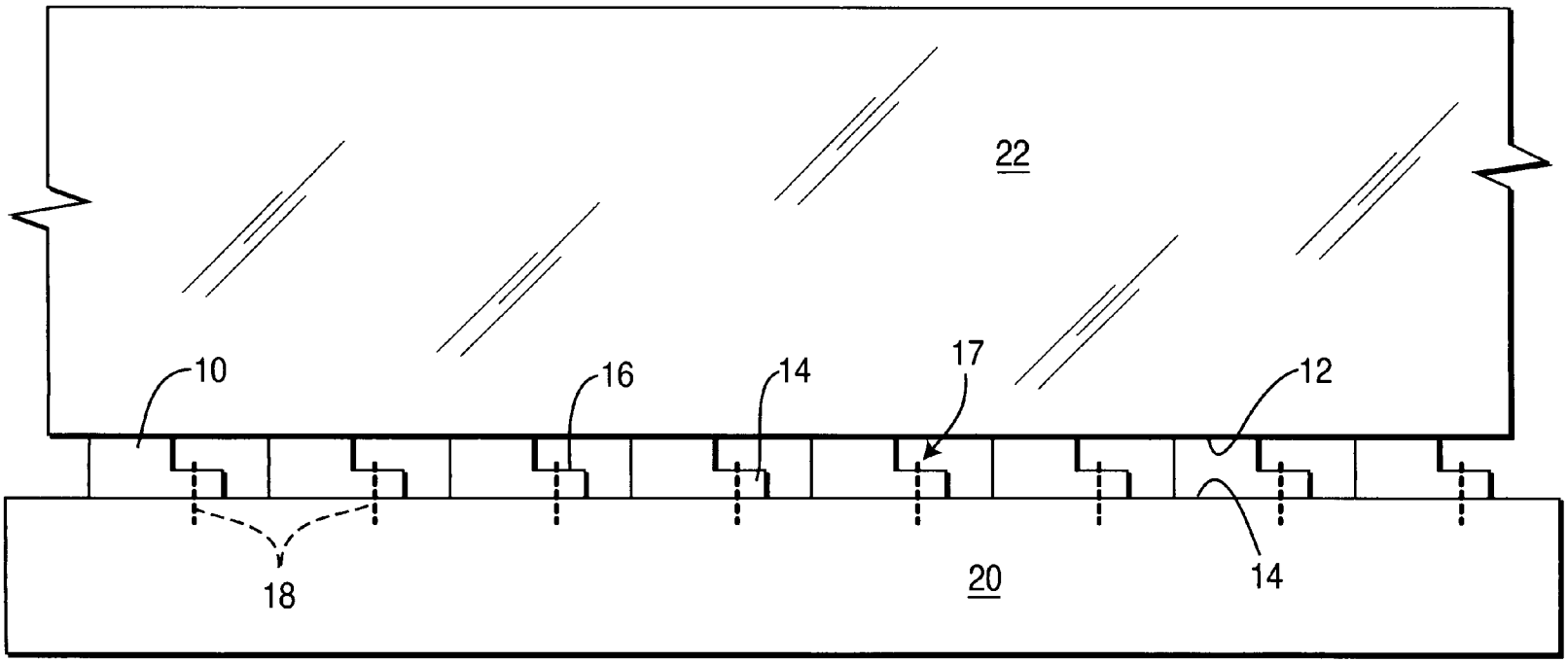
FIG. 7 is a side cross-sectional view of one or more glass panels shown positioned upon an array of individual support means for jointly supporting fragile articles of the present invention thereupon while the array is mounted upon a pallet.

FIG. 7 shows a plurality of the support means 10 mounted upon a substrate pallet 20 in an array extending generally parallel to one another to facilitate the supporting of the fragile glass panels 22 thereupon for shipping. The staples 18 are shown in dotted outline driven through each of the upper supporting surfaces 14 of the respective mounting members 34 extending along one lateral edge of each of the members 10 for securement thereof to the substrate 20. FIG. 7 shows a most basic embodiment of the support system of the present invention.

It is important that the detailed construction of the longitudinally extending support means 10 of the present invention be appreciated. The support means 10 includes a support member 11 and a mounting member 34 preferably formed from a single integral piece of fiberboard. In the preferred configuration the mounting member 34 is positioned adjacent to the support member 11 and is recessed downwardly therefrom to space the staples 18 from fragile articles 22. Also in the preferred configuration the support member 11 and the mounting member 34 are formed as a single integral member such that securement of the mounting member 34 to the substrate 20 therebelow will also attach the support member 11 to the same substrate. With this configuration the mounting member 34 will define a lower securement surface 38 which will abut the substrate 20 when the mounting member 34 is secured thereto. Similarly the support member 11 will define a lower supporting surface 12 which will be brought into abutment with the substrate 20 when the support means 10 is positioned thereon for holding of fragile articles 22 thereabove. In this manner securement of the mounting member or lip 34 to the substrate 20 will also firmly attach the supporting member 11 thereto. In the preferred configuration the lower securement surface 38 of the mounting member 34 and the lower supporting surface 12 of the support member 11 are formed as a single coplanar and integrally connected surface.

The upper supporting surface 14 of each support member 11 is preferably defined in a horizontally extending support plane 40. In a similar manner the upper securement surface 16 of each mounting member 34 will be defined within a generally horizontally extending surface securement plane 42. It is preferable that the securement plane 42 be parallel to the support plane 40 but displaced at a significant distance downwardly therefrom. This spacing between the support plane 40 and the securement plane 42 will define the safety zone 17 therebetween. This safety zone provides spacing between fragile articles 22 positioned on the upper supporting surfaces 14 and the securing staples 18 therebelow, which will preferably be driven downwardly through the upper securement surfaces 16 and the mounting members 34 and then through the upper substrate surface 36 in order to be embedded within the substrate or pallet 20 positioned therebelow. The vertical displacement between the upper supporting surface 14 and the upper securement surface 16 allows positioning of the securing fasteners such as staples 18 at a position spatially distant from the fragile articles supported upon the upper supporting surface 14.

In the preferred configuration each support member 11 and the associated mounting member 34 will be formed as a single integral member and be made from medium density fiberboard 28 to facilitate structural integrity thereof to facilitate machining thereof. Preferably, a single integral piece of medium density fiberboard can be routed or otherwise machined or milled to define the longitudinally extending slot 15 therein for defining the mounting member or lip 34. This mounting member 34 can be defined along one lateral edge of the support means 10 as shown in FIGS. 2, 3 and 4 or can be defined on both lateral edges to define a double shoulder cross section 24 as shown in FIG. 6. Alternatively a central slot 26 can be formed to define the mounting member 34 centrally on the support means 10 as shown best in FIG. 5.

The support member 11 of the present invention preferably includes a main body 44 with an upper panel 30 extending across the upper surface thereof to define the upper supporting surface 14. Preferably this upper panel 30 will be formed of a material having a lower coefficient of friction than the coefficient of friction on the surface if defined by the medium density fiberboard material 28 itself. In this manner the flexible resilience of the medium density fiberboard can be used for providing safe flexible resilient support while at the same time allowing a decrease in the coefficient of friction of the contact surface thereof with respect to fragile articles 22 which are often slid across the upper supporting surface 14 while in contact therewith. There are numerous other reasons for controlling the slipperiness or coefficient of friction of the upper supporting surface 14 and this is achieved by laminating or otherwise attaching of upper panels 30 extending across the upper supporting surface 14 which is formed of various materials such as plastic or mylar or paper which may be coated with wax or other materials.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. Means for safely supporting fragile articles being mountable upon a substrate therebelow by securement devices driven therethrough comprising:

A. a support member extending longitudinally and made of a flexibly resilient material and adapted to be positioned upon a substrate therebelow for mounting thereon, said support member including:

(1) an upper supporting surface defining a support plane extending thereacross for supporting fragile articles thereupon, said upper supporting surface adapted to support fragile articles thereupon in spaced relation to the substrate therebelow to facilitate protection thereof;

(2) a lower supporting surface positioned spatially distance from and below said upper supporting surface and adapted to abut a substrate located therebelow to facilitate mounting thereupon;

B. a mounting member affixed to said support member and extending longitudinally therealong, said mounting member being securable with respect to the substrate in abutment therebeneath for facilitating attaching of said support member with respect thereto, said mounting member including:

(1) a lower securement surface positionable in abutment with respect to a substrate therebelow responsive to positioning of said lower supporting surface of said support member into abutment with respect to the substrate;

(2) an upper securement surface located at a position laterally adjacent and below said upper supporting surface of said support member and positioned spaced from and above said lower securement surface, said upper securement surface defining a securement plane positioned spaced below said support plane, said upper securement surface being adapted to receive a securement device driven therethrough into engagement with the substrate therebelow to facilitate securement of said mounting member to the substrate therebelow and for mounting of said support member with the lower supporting surface thereof in abutment with and mounted upon the substrate positioned therebeneath, said upper securement surface defining a safety zone means thereabove in the area below said support plane of said upper supporting surface to facilitate maintaining of spacing between any securement devices extending through said mounting member and any fragile article positioned upon said upper supporting surface; and C. a plurality of securement means capable of being driven into said upper securement surface and through said mounting member into a substrate therebelow for securing said mounting member thereto and for attaching said support member with respect to the substrate immediately below aid lower supporting surface thereof.

2. Means for safely supporting fragile articles being mountable upon a substrate therebelow by securement devices driven therethrough as defined in claim 1 wherein aid safety zone means is positioned below said support plane and above said securement plane.

3. Means for safely supporting fragile articles being mountable upon a substrate therebelow by securement devices driven therethrough as defined in claim 1 wherein said support plane of said upper supporting surface and said securement plane of said mounting member extend parallel with respect to one another.

4. Means for safely supporting fragile articles being mountable upon a substrate therebelow by securement devices driven therethrough as defined in claim 1 wherein said support plane of said upper supporting surface and said securement plane of said mounting member extend generally horizontally and parallel with respect to one another.

5. Means for safely supporting fragile articles being mountable upon a substrate therebelow by securement devices driven therethrough as defined in claim 1 wherein said support member and said mounting member are integrally formed with respect to one another.

6. Means for safely supporting fragile articles being mountable upon a substrate therebelow by securement devices driven therethrough as defined in claim 1 wherein said support member is formed of a fiberboard material.

7. Means for safely supporting fragile articles being mountable upon a substrate therebelow by securement devices driven therethrough as defined in claim 6 wherein said support member and said mounting member are formed integrally from fiberboard material.

8. Means for safely supporting fragile articles being mountable upon a substrate therebelow by securement devices driven therethrough as defined in claim 1 wherein said support member and said mounting member are formed integrally from medium density fiberboard material to facilitate machining thereof.

9. Means for safely supporting fragile articles being mountable upon a substrate therebelow by securement devices driven therethrough as defined in claim 1 wherein said securement means comprise staples.

10. Means for safely supporting fragile articles being mountable upon a substrate therebelow by securement devices driven therethrough as defined in claim 9 wherein said staples are smaller than said safety zone means in order to prevent staples partially embedded into said mounting member through said upper securement surface from extending upwardly through said support plane.

11. Means for safely supporting fragile articles being mountable upon a substrate therebelow by securement devices driven therethrough as defined in claim 1 wherein said upper supporting surface extends generally horizontally within said support plane and wherein said upper securement surface extends generally horizontally within said securement plane.

12. Means for safely supporting fragile articles being mountable upon a substrate therebelow by securement devices driven therethrough as defined in claim 1 wherein said upper supporting surface extends generally parallel to and above said lower supporting surface.

13. Means for safely supporting fragile articles being mountable upon a substrate therebelow by securement devices driven therethrough as defined in claim 1 wherein said upper securement surface extends generally parallel to and above said lower securement surface.

14. Means for safely supporting fragile articles being mountable upon a substrate therebelow by securement devices driven therethrough as defined in claim 1 wherein aid lower supporting surface and said lower securement surface are coplanar relative to each other.

15. Means for safely supporting fragile articles being mountable upon a substrate therebelow by securement devices driven therethrough as defined in claim 1 wherein said support member includes a main body of fiberboard and an upper panel extending over said main body to define said upper supporting surface thereof to facilitate usage thereof supporting of fragile articles thereupon.

16. Means for safely supporting fragile articles being mountable upon a substrate therebelow by securement devices driven therethrough as defined in claim 15 wherein said upper panel has a surface coefficient of friction less than the coefficient of friction of the fiberboard of said main body to facilitate control of movement of fragile articles across said upper supporting surface.

17. Means for safely supporting fragile articles being mountable upon a substrate therebelow by securement devices driven therethrough as defined in claim 16 wherein said upper panel is made of a plastic material.

18. Means for safely supporting fragile articles being mountable upon a substrate therebelow by securement devices driven therethrough comprising:

a. a support member extending longitudinally and made of a flexibly resilient fiberboard material and adapted to be positioned upon a substrate therebelow for mounting thereon, said support member including:
   i. a main body of fiberboard;
   ii. an upper supporting surface positioned on said main body and defining a support plane extending thereacross for supporting fragile articles thereupon, said upper supporting surface 3 adapted to support fragile articles thereupon in spaced relation to the substrate therebelow to facilitate protection thereof;
   iii. a lower supporting surface positioned spatially distance from and below said upper supporting surface and generally extending parallel with respect thereto, said lower supporting surface adapted to abut a substrate located therebelow to facilitate mounting thereupon;
   iv. an upper panel of plastic material extending over said main body to define said upper supporting surface thereof to facilitate moving and supporting of fragile articles positioned thereupon;

b. a mounting member of fiberboard integrally formed with said support member and extending longitudinally therealong, said mounting member being securable with respect to the substrate in abutment therebeneath for facilitating attaching of said support member with respect thereto, said mounting member including:
   i. a lower securement surface positionable in abutment with respect to a substrate therebelow responsive to positioning of said lower supporting surface of said support member into abutment with respect to the substrate;
   ii. an upper securement surface extending generally horizontally and located at a position laterally adjacent and below said upper supporting surface of said support member and positioned spaced from and above said lower securement surface, said upper securement surface defining a securement plane extending generally horizontally positioned spaced below said support plane and extending parallel with respect to said support plane of said upper supporting surface, said upper securement surface extending generally parallel to and above said lower securement surface, said lower supporting surface and said lower securement surface being coplanar to one another, said upper securement surface being adapted to receive a securement device driven therethrough into engagement with the substrate therebelow to facilitate securement of said mounting member to the substrate therebelow and for mounting of said support member with the lower supporting surface thereof in abutment with and mounted upon the substrate positioned therebeneath, said upper securement surface defining a safety zone means thereabove in the area below said support plane of said upper supporting surface to prevent contact between any securement devices extending therethrough and any of the fragile articles positioned upon said upper supporting surface, said safety zone means being positioned below said support plane and above said securement plane; and c. a plurality of securement means capable of being driven into said upper securement surface and through said mounting member into a substrate therebelow for securing said mounting member thereto and for attaching said support member with respect to the substrate immediately below aid lower supporting surface thereof.

* * * * *